United States Patent [19]

Settlemier et al.

[11] Patent Number: 4,965,922

[45] Date of Patent: Oct. 30, 1990

[54] METHOD FOR DISMANTLING A NATURAL GAS HOLDER

[75] Inventors: Brock R. Settlemier, Piedmont; Steven R. Bone, Walnut Creek; John Tolivaisa, Pacifica; James E. Nugent, Walnut Creek, all of Calif.

[73] Assignee: Bigge Crane & Rigging Co., San Leandro, Calif.

[21] Appl. No.: 451,228

[22] Filed: Dec. 15, 1989

[51] Int. Cl.[5] ..... B23P 19/02

[52] U.S. Cl. ..... 29/426.4; 29/426.1

[58] Field of Search ..... 29/426.4, 426.5, 426.1

[56] References Cited

U.S. PATENT DOCUMENTS 4,692,981 9/1987 Homes ..... 29/426.4

FOREIGN PATENT DOCUMENTS 29614 3/1977 Japan ..... 29/426.1

31498 3/1977 Japan ..... 29/426.1

*Primary Examiner*—P. W. Echols

*Assistant Examiner*—David P. Bryant

*Attorney, Agent, or Firm*—Bruce & McCoy

[57] ABSTRACT

A method for dismantling a gas holder structure by alternately lifting and lowering the gas holder while disassembling it around the bottom.

7 Claims, 7 Drawing Sheets

METHOD FOR DISMANTLING A NATURAL GAS HOLDER

CROSS-REFERENCE TO RELATED APPLICATION

The present invention is related to the copending patent application for a support cradle for load equalization filed concurrently herewith.

BACKGROUND OF THE INVENTION

1. Field of the Invention

The present invention relates to methods for dismantling large structures, and more particularly, it relates to a method for dismantling a natural gas holder weighing approximately 3,000 tons by disassembly from the bottom and lowering of the structure until it is of a height that it can be dismantled by other means.

2. Description of the Prior Art

There are a large number of natural gas holders which have been in service for 50 years or more located around the country. Other means have now been established for storing the natural gas under pressure and underground in less obtrusive facilities. It has therefore been the object of the owners of these out-of-date storage facilities to dismantle them and remove them from their present sites. However, there are serious problems in attempting to do so since these structures weigh in the range of 3,000 tons and stand nearly 400 feet high and can be as much as 250 feet in diameter. Disassembly from the top involves extreme danger to the laborers working at such height and from the possibility of dropping the parts or pieces which could cause injury to workers on the ground. In addition, if disassembly begins at the top, the structure loses its integrity and internal support. Therefore, a novel means of disassembly had to be devised. There was no known means by which this could be accomplished.

SUMMARY OF THE INVENTION

The present invention is the method of dismantling a natural gas holder having vertical columns disposed around the periphery of the holder to which the enclosure shell of the holder is attached. The process comprises the steps of providing hydraulic jacks at every other column around the periphery of the shell. The control of the jacks is divided into three approximately equal sectors of adjacent jacks whereby each jack in each sector exerts the same lifting force. The columns and adjacent portions of the enclosure shell are then cut away where each jack is located to permit a partially extended jack to be inserted under each of the partially removed columns. The jacks are inserted under the respective columns and extended to lift the weight of the gas holder by the jack in three-point effective support. The remaining columns are then cut lose from their base attachments and support cradles are provided at each of the remaining columns. The remaining columns are then cut away with the adjacent portions of the enclosure shell at each column where the cradles are located to a height slightly above the height of the cradles. The cradles are then inserted under the respective columns and are lifted into contact with the columns with approximately equal lifting force on each of the columns. The jacks are then lowered until the weight of the gas holder is supported by the cradles. Then the columns and enclosure shell are cut away around the bottom of the gas holder, except where the holder is supported by the cradles, to a height slightly less than an extended jack. The jacks are then extended to lift the weight of the gas holder by the jacks again in three-point effective support. The enclosure shell and columns above the cradles are then cut away to a height slightly less than the extension length of the jacks The jacks are then lowered until the weight of the gas holder is again supported by the cradles. The previous four steps are then repeated successively in their same order until the gas holder is lowered in height until it can be dismantled in any other manner.

OBJECTS OF THE INVENTION

It is therefore an important object of the present invention to provide a unique means for supporting a very large structure by three-point suspension.

It is another object of the present invention to provide a method for dismantling a very large structure from the bottom leaving the integrity of the structure intact throughout the disassembly.

It is a further object of the present invention to provide a means for lowering and dismantling a large structure in successive small steps whereby laborers do not have to work at the top of the structure during the operation.

It is still another object of the present invention to provide a method for disassembly of a 3,000-ton gas holder which is comprised of a multiple of columns disposed in a cylindrical configuration approximately 400 feet high, 250 feet in diameter, and held together by the enclosure shell.

It is still a further object of the present invention to provide a means for stabilizing the gas holder internally during lowering utilizing the existing structure of the holder.

And it is yet a further object of the present invention to provide a means for preloading the support cradles which carry the load of the structure after the jacks have been lowered and the three-point suspension has been removed.

Other objects and advantages of the present invention will become apparent when the method of the present invention is considered in conjunction with the accompanying drawings.

DESCRIPTION OF THE PREFERRED EMBODIMENT

Figure 11:
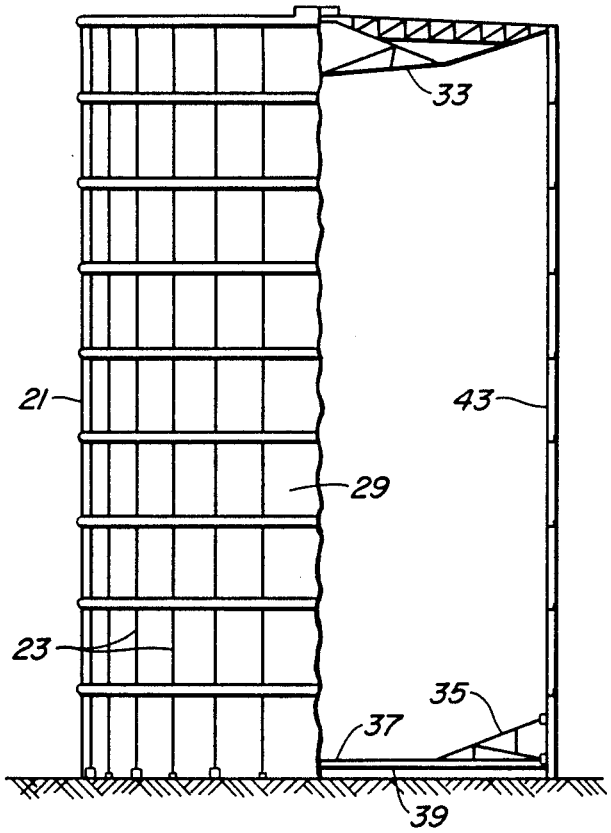
FIG. 11 shows a natural gas holder prior to dismantling with the alternating cut away holes around the base showing the larger holes in the structure for the jack assemblies and the smaller holes for the cradle assemblies.

Reference is made to the drawings for a description of the preferred embodiment of the present invention wherein like reference numbers represent like elements on corresponding views. FIG. 11 shows a typical gas holder 21 in partial section with the support columns disposed around the periphery of the enclosure to which the shell 29 of the enclosure is attached. The roof truss structure 33 is formed to allow the truss structure 35 of the floating piston 37 to approach close thereto in a mating relation to allow for maximum volume in the gas holder.

Figure 1:
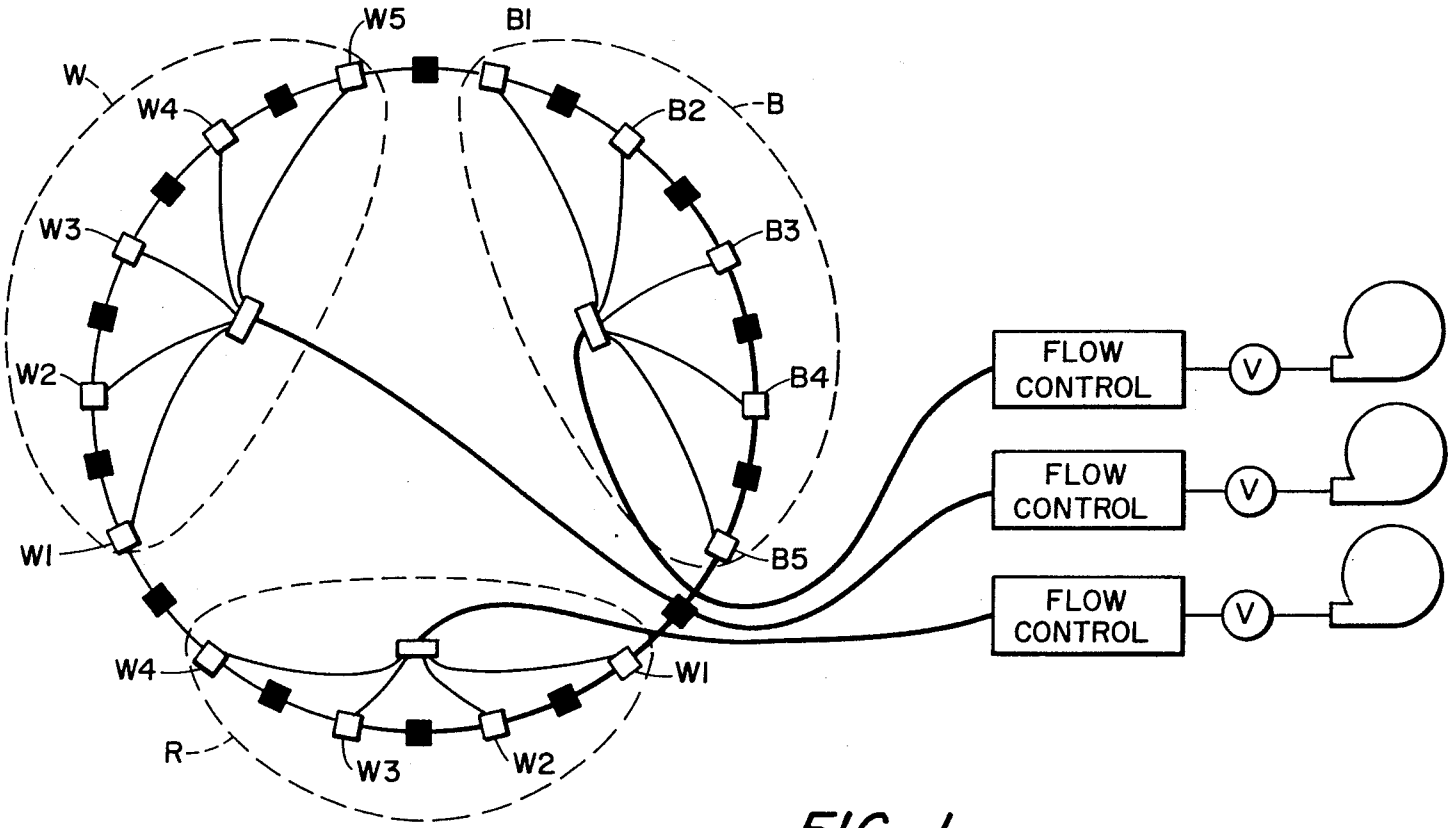
FIG. 1 is a top plan view diagram of the arrangement of the alternating jacks and cradles which are utilized for the method of the present invention of supporting a gas holder by effective three-point suspension during dismantling and showing the hydraulic control system which creates three-point support for the structure while it is being supported by the hydraulic jacks.

FIG. 1 illustrates schematically the control system for alternatively supporting the weight of the gas holder 21 during dismantling by means of cradles 25 and hydraulic jacks 27 to accomplish the disassembly. The squares represent the individual columns of the gas holder to which the enclosure shell 29 is attached. The columns are secured at their bases to concrete pads 31 which are utilized in the method to mount the cradles and hydraulic jacks on. When the hydraulic jacks are actuated, they are controlled by three separate hydraulic systems whereby all adjacent hydraulic jacks in a sector are controlled and receive the same hydraulic pressure from a single pump so they lift with uniform force. The sectors are labeled by colors such as red (a), white (b), and blue (c), whereby all of the jacks and their associated plumbing and control systems are color-coded with their respective color designation. Thus, when the structure is supported by the jacks, it is supported in effectively a three-point suspension.

The amount of lifting or lowering which has occurred when the jacks are actuated can be simply determined by reference points which are established prior to movement and which are monitored in relation thereto during lowering to keep the structure level. The levelness can be determined by a physical eyeball read out, or the level monitoring system can be accomplished by electronics means utilizing a position indicator which is a transducer with a digital read out. The electronic position indicator is the easiest to use. It is comprised of simply a commercially available unit which is a box with a pull-string that has a magnet attached thereto whereby the box is set on the base for the columns and the magnet with the string attached is lifted until it attaches to the bottom of the tank edge. Thereafter, vertical variations of movement of the string caused by structure movement read in hundredths of an inch on a digital read out meter. Only three monitors are necessary with the physical read outs being wired into the control cab from which the operator operates the hydraulic systems. For a physical read out, a scale is established measuring from reference poles located at three spaced points around the tank holder proximate the center of each sector of lifting whereby as the holder is lowered, three observers can monitor the lowering movement of the bottom edge of the structure in relation to markings on the poles and radio or call their changing read outs to the hydraulic controls operator.

Figure 12:
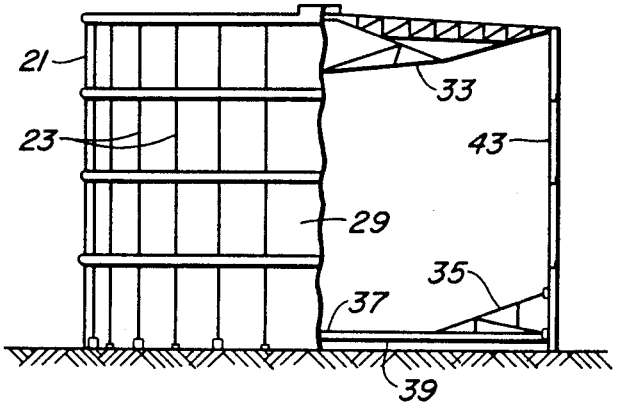
FIG. 12 shows the natural gas holder partially dismantled and at a substantially reduced height during the process of disassembly.
Figure 13:
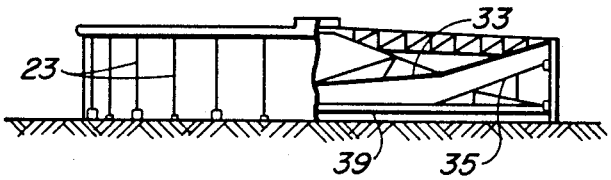
FIG. 13 shows the gas holder in the fully dismantled condition accomplished by the method of the present invention whereby the height of the gas holder has been lowered to a point where other means of disassembly may be employed.
Figure 14A:
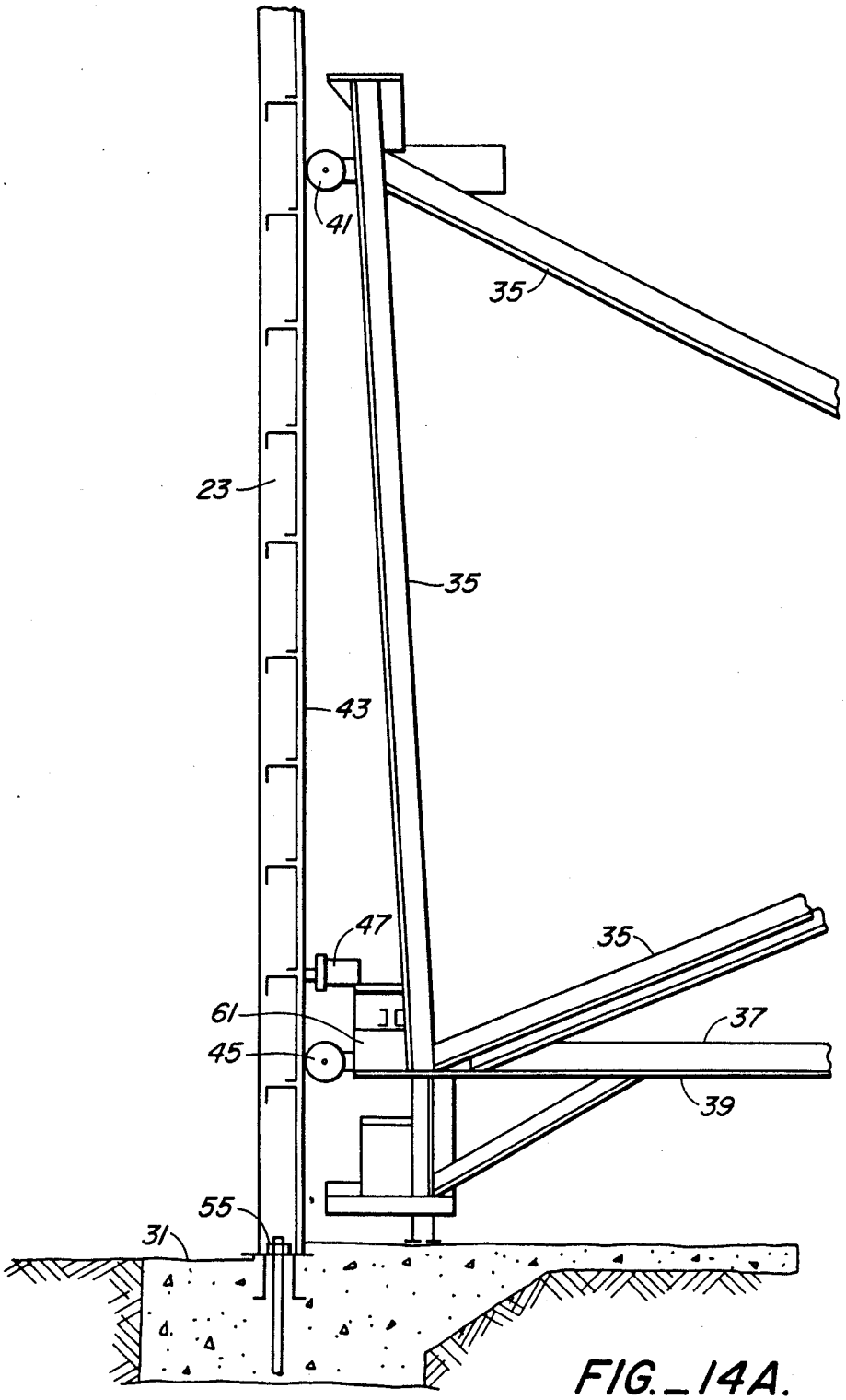
FIG. 14A is a broken out partial side elevation of a wall and a column and portion of shell enclosure showing the original structure of the internal piston used for stabilizing the gas holder during dismantling.
Figure 14B:
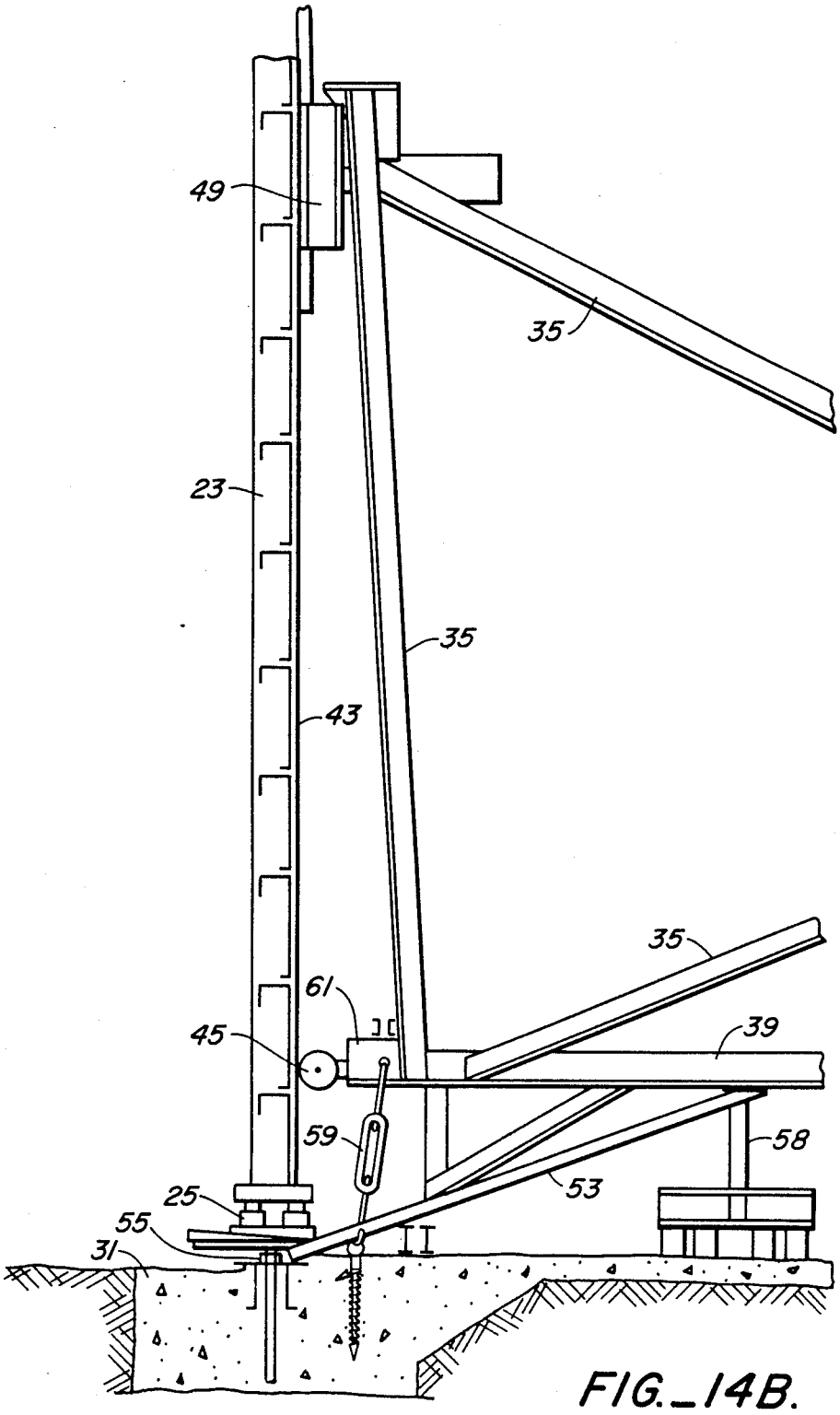
FIG. 14B is a broken out partial side elevation of a wall and a column and portion of shell enclosure showing the modified structure of the internal piston used for stabilizing the gas holder during dismantling.

The gas holders 21 include an internal piston 37 which floats on the volume of gas stored in the holder. It is shown disposed at the bottom of the empty gas holders of FIGS. 11–13. The piston is essentially a flat cover 39 with a truss structure 35 built around the periphery of the cover which stabilizes it inside the gas holder. In order to provide internal support for the gas holder as it is disassembled, the internal piston is utilized as a guide around which the gas holder is lowered. To do this, it is modified as shown in FIG. 14B while FIG. 14A shows the structure of the internal truss work before it is modified for this purpose. It will be seen that disposed at the upper end of the truss structure of the piston are rollers 41 which are located to contact each of the columns 23 around the internal surface 43 of the shell enclosure so that the piston moves easily up and down inside the gas holder. The lowest level of the truss structure is also provided with rollers 45 proximate the seal 47 or flat plate at the top of the piston.

In order to modify the piston 37 to provide additional support during the dismantling operation, the upper rollers are removed and replaced with skid pads 49 to relieve the point loading and to distribute the stress over a longer length of the columns. These skid pads are sections of flat plate approximately five feet long secured at the upper ends of the truss structure at each of the columns to bear against the columns and spread out the load through the area of contact of the sliding beam.

The lower end of the piston is also modified by being provided with a multiplicity of additional support bases 58 disposed under the piston at positions disposed radially inward from the periphery of the piston. A pair of tie-down anchors are provided along with an additional support base: one in the form of a beam 53 which extends down and out from the piston plate and is tied to the anchor bolts 55, and a second which is an anchor screw 57 forced into the concrete pad 31 and tied with a turnbuckle 59 to the end 61 of the beam structure forming the top of the piston 37. These alterations tie the piston to the base structure of the gas holder and rigidly support the upper portions of the piston truss structure in position thereby internally bracing the gas holder 21.

Figure 2:
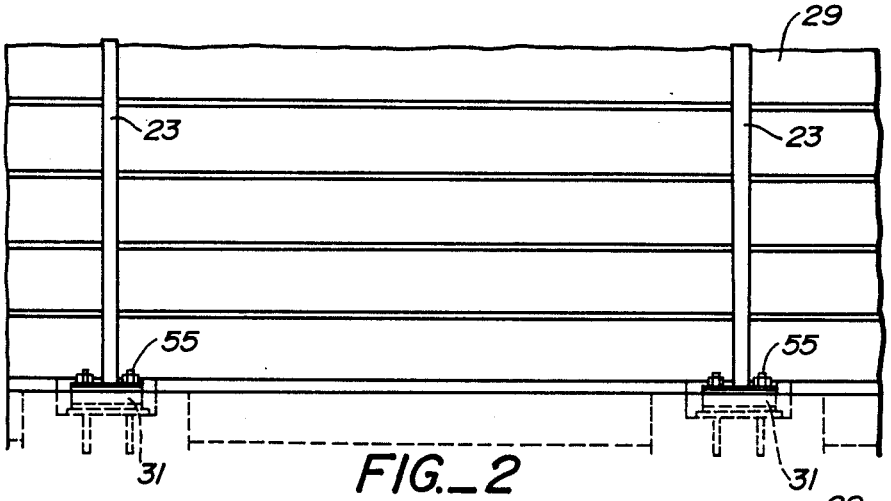
FIG. 2 is a side elevation of a lower edge portion of a gas holder showing two adjacent support columns with the enclosure shell attached thereto.
Figure 3:
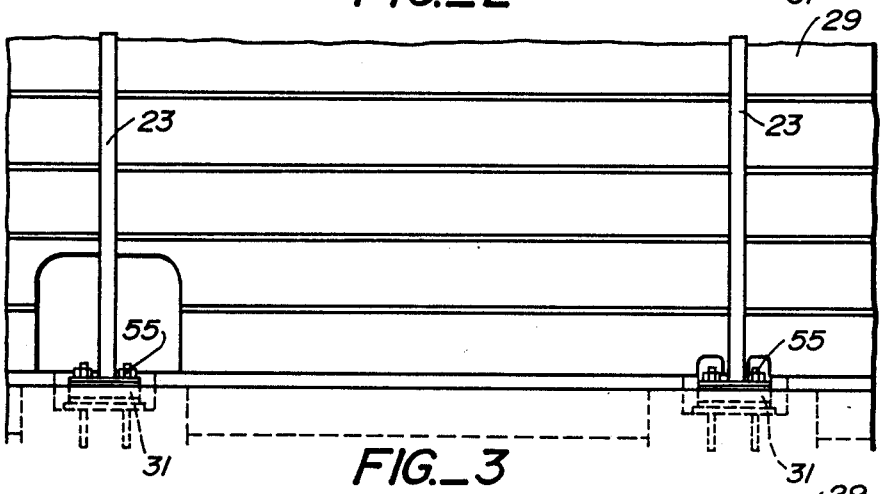
FIG. 3 is an illustration of FIG. 2 at a later stage of the dismantling method of the present invention showing on the left side of the figure the cut out portion of the shell enclosure where a hydraulic jack is to be disposed and on the right side the cut outs in the shell enclosure where a cradle is to be disposed.

To commence the dismantling of the enclosure as shown in FIG. 2, hydraulic jacks 27 are provided at every other column 23 around the periphery of the enclosure. Control of the jacks is divided into approximately three equal sections of adjacent jacks whereby each jack in each sector provides the same lifting force and carries the same load. The support columns and adjacent portions of the enclosure shell 29 are cut away where each jack is located, as shown at the left of FIG. 3, to permit a partially extended jack to be inserted under the cut off end of the support columns on the concrete column support pads 31 shown in phantom lines. The shell is cut away minimally with rounded corners to retain as much of the shell strength and support for the columns as possible. The weight of the gas holder is then lifted by the jacks in effective three-point support.

Figure 4:
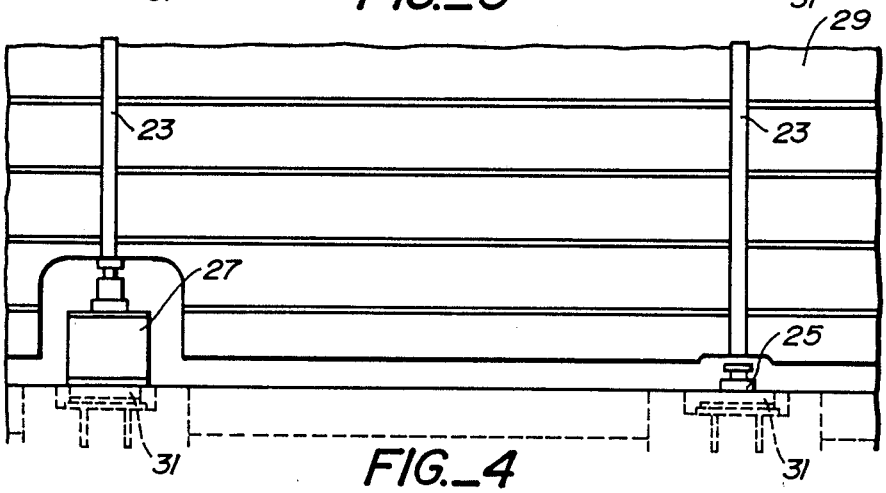
FIG. 4 is an illustration of FIG. 3 at a further stage of dismantling of the gas holder showing the hydraulic jack in position on the left side supporting the load of the gas holder structure with the cradle inserted on the right-hand side before the structure is lowered onto the cradles.

After the weight of the gas holder 21 has been taken onto the jacks 27 as shown at the left in FIG. 4, the remaining columns 23 are cut loose from their base attachments 31 as shown at the right in FIG. 3, and support cradles 25 are provided at each of the columns. The cradles are provided with pressure equalizing means which allow for approximately equal weight to be borne by each of the cradles. The equalizing means includes cribs which contain a semi-active elastomeric material, called fabreeka, which is effective in equalizing the load among the cradles when the material is compressed by the load being lowered onto the cradles.

The cradles are also provided with wedging means for lifting the cradles into contact with the lower ends of the cut off support columns for preloading each of the cradles before the jacks lower the load onto the cradles. The semi-active member in the support cradles accommodates variations in preloading and variations caused by irregular cuts on the bottoms of the columns.

Figure 5:
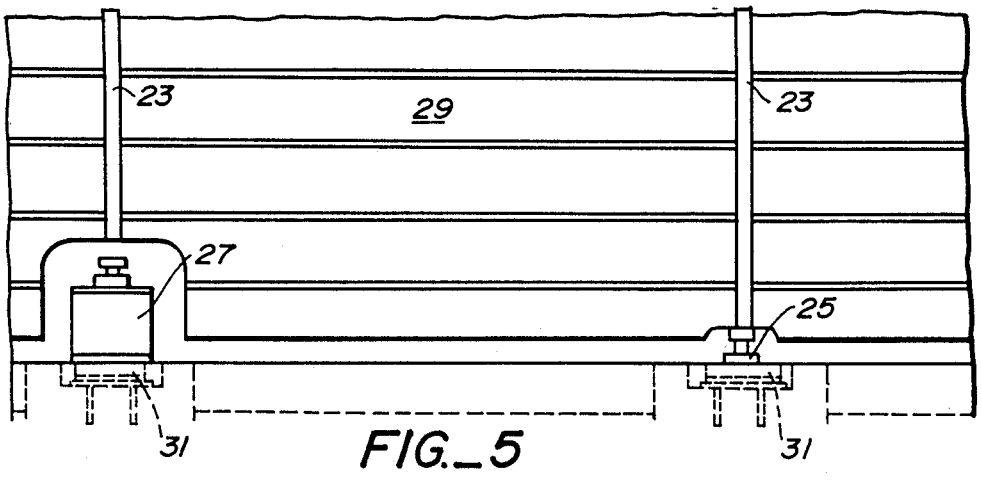
FIG. 5 is an illustration of FIG. 4 at a later stage of dismantling after the load of the structure has been lowered by the hydraulic jacks onto the cradles.
Figure 6:
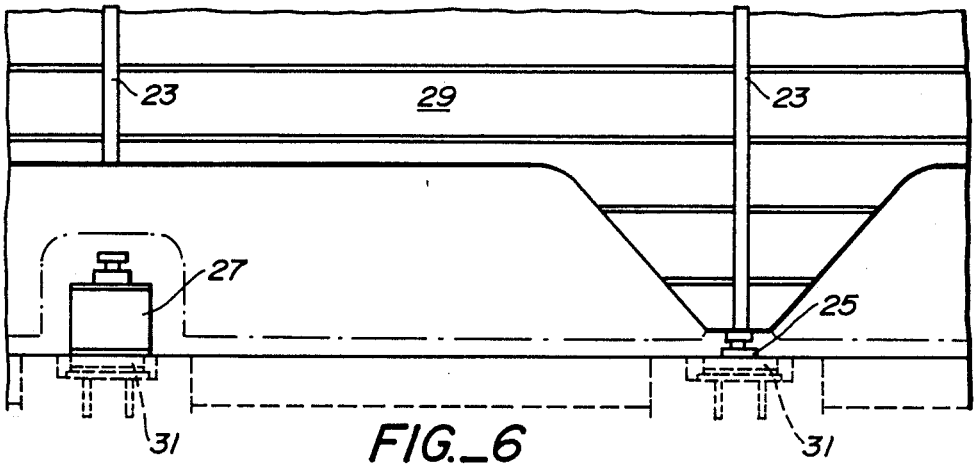
FIG. 6 is an illustration of FIG. 5 at a later stage of dismantling of the gas holder wherein the enclosure shell has been cut away and removed while the load is supported by the cradles.

The columns where the cradles are located are cut off along with adjacent portions of the enclosure shell to a height slightly above the height of the cradles as shown on the right side of FIG. 4. The cradles are then inserted under their respective columns and the cradles are lifted into contact by preloading with approximate equal lifting force on each of the columns. The jacks are then lowered until the weight of the gas holder is supported by the cradles as shown in FIG. 5. The enclosure shell and the columns around the bottom of the gas holder, except where the holder is supported by cradles, is cut away to a height slightly less than an extended jack as shown in FIG. 6. A substantial amount of shell is left to support the length of exposed column resting on the cradle.

Figure 7:
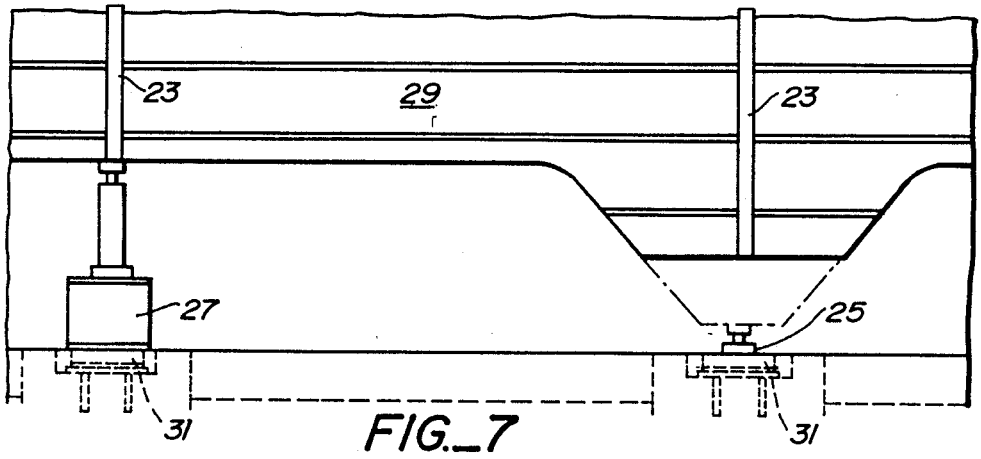
FIG. 7 is an illustration of FIG. 6 at a later stage of dismantling when the jacks have been extended to again support the load of the structure in three-point suspension and the support columns and enclosure shell at the locations of the support cradles have been cut away to a height to permit the jacks to lower the structure by the amount of enclosure removed.
Figure 8:
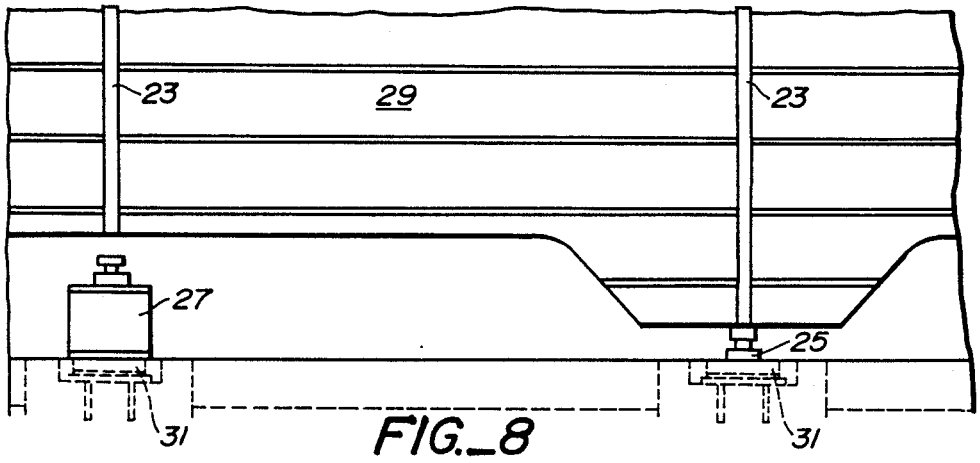
FIG. 8 is an illustration of FIG. 7 at a later stage of dismantling at which time the hydraulic jacks have been lowered to shift the load to the support cradles.

The weight of the gas holder is then lifted by the jacks, again in three-point effective support, and the enclosure shell and the columns above the cradles are then cut away to a height slightly less than the extension length of the jacks as shown in FIG. 7. The jacks are then lowered whereby the shell and columns are lowered down around the piston structure until the weight of the gas holder is again supported by the cradles as shown in FIG. 8. The previous four steps are then repeated in their same order until the gas holder has been lowered in height to where it can be dismantled in any other manner.

Figure 9:
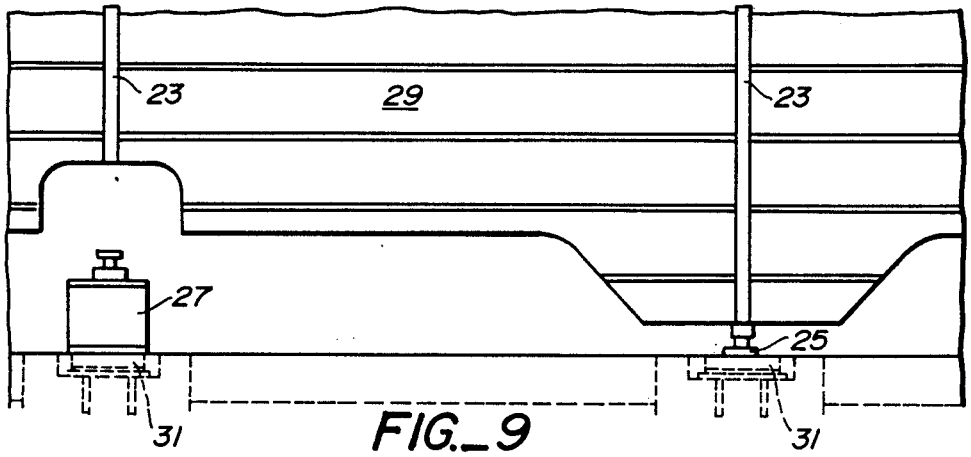
FIG. 9 is an illustration of FIG. 8 at a later stage of dismantling when the enclosure shell and columns around the hydraulic jacks have been cut away to permit the jack to extend and again take the load off the cradles.
Figure 10:
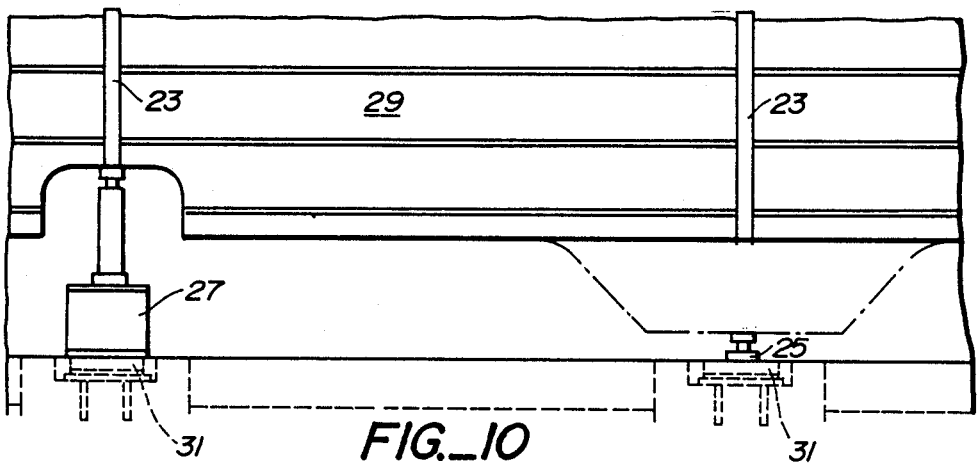
FIG. 10 is an illustration of FIG. 9 at a later stage of dismantling showing the load supported again by the hydraulic jacks in effective three-point suspension and with that portion of the shell enclosure and columns at the locations of the cradles having been cut away and removed.

While the steps are the same, the configurations of the cuts made in removing the shell structure are slightly different in the succeeding steps as shown in FIGS. 8–10. The next cut for the jacks as shown at the left in FIG. 9 penetrates into the shell a smaller amount than the first cut and leaves more support for the column which becomes increasingly important as the enclosure gets shorter and the stress in the shell and columns increases. The next cut above the cradles cuts the shell off level as shown in FIG. 10 on the right side and the shell does not thereafter experience the extreme one time loading as shown in FIG. 6 on the right. All successive steps utilize configurations of dismantling as shown in FIGS. 8–10.

Thus, it will be apparent from the foregoing description of the invention, in its preferred form, that it will fulfill all the objects and advantages attributable thereto. While it is illustrated and described in considerable detail herein, the invention is not to be limited to such details as have been set forth except as may be necessitated by the appended claims.

We claim:

1. A method of dismantling a natural gas holder having vertical support columns disposed around the periphery of said holder to which the enclosure shell of the holder is attached, the method comprising, providing hydraulic jacks at every other column around the periphery of the shell, dividing control of the jacks into three approximately equal sectors of adjacent jacks whereby each jack in each sector exerts the same lifting force, cutting away the columns and adjacent portions of the enclosure shell where each jack is located to permit a partially extended jack to be inserted thereunder, inserting the jacks under their respective columns and lifting the weight of the gas holder by the jacks in three-point effective support, cutting the remaining columns loose from their base attachments and providing support cradles at each of said remaining columns, cutting off the columns and adjacent portions of the enclosure shell where the cradles are located to a height slightly above the height of the cradles, inserting the cradles under their respective columns and lifting such cradles into contact therewith for preloading with approximately equal lifting force on each of said columns, lowering the jacks until the weight of the gas holder is supported by the cradles, cutting away the enclosure shell and columns around the bottom of the gas holder except where the holder is supported by the cradles to a height slightly less than an extended jack, lifting the weight of the gas holder by the jacks in three-point effective support, cutting away the enclosure shell and columns above the cradles to a height slightly less than the extension length of the jacks, lowering the jacks until the weight of the gas holder is again supported by the cradles, and repeating the previous four steps in their same order until the gas holder has been lowered in height to where it can be dismantled in any other manner.

2. The method of claim 1 wherein the gas holder has an internal piston comprised of a truss structure, the method including the step of bracing the gas holder internally during the disassembly by tying the piston structure to the base of the gas holder and lowering the shell and columns down around the piston structure as they are cut off around the bottom.

3. The method of claim 2 wherein the piston structure is modified by providing a skid pad at the upper ends of the piston truss structure proximate the columns to provide increased bearing surface areas between the upper periphery of the piston where it contacts the gas holder internally at each column.

4. The method of claim 1 wherein the support cradles are provided with pressure equalizing means which allow for approximately equal loads to be born by each of the cradles each time the jacks are lowered.

5. The method of claim 4 wherein the support cradles are provided with cribs containing fabreeka material which is semi-active in equalizing the load among the cradles when the fabreeka is compressed by the load being lowered onto the cradles.

6. The method of claim 5 wherein the support cradles are provided with wedging means for lifting the cradles into contact with the lower ends of the support columns for preloading each of said cradles before the jacks are lowered.

7. A method of dismantling a natural gas holder having vertical support columns disposed around the periphery of said holder to which the enclosure shell of the holder is attached and an internal piston comprised of a truss structure, the method comprising, bracing the gas holder internally by tying the piston structure to the base of the gas holder, providing a skid pad at the upper ends of the piston truss structure proximate the columns to provide increased bearing surface areas at the upper periphery of the piston where it contacts the gas holder internally at each column, providing hydraulic jacks at every other column around the periphery of the shell, dividing control of the jacks into three approximately equal sectors of adjacent jacks whereby each jack in each sector exerts the same lifting force, cutting away the columns and adjacent portions of the enclosure shell where each jack is located to permit a partially extended jack to be inserted thereunder, inserting the jacks under their respective columns and lifting the weight of the gas holder by the jacks in three-point effective support, cutting the remaining columns loose from their base attachments and providing support cradles at each of said remaining columns, said cradles being provided with pressure equalizing means which allow for approximately equal loads to be born by each of the cradles, said equalizing means including cribs containing fabreeka material which is semi-active in equalizing the load among the cradles when the fabreeka is compressed by the load being lowered onto the cradles, and said cradles being provided with wedging means for lifting the cradles into contact with the lower ends of the support columns for preloading each of said cradles before the jacks are lowered, cutting off the columns and adjacent portions of the enclosure shell where the cradles are located to a height slightly above the height of the cradles, inserting the cradles under their respective columns and lifting such cradles into contact therewith for preloading with approximately equal lifting force on each of said columns, lowering the jacks until the weight of the gas holder is supported by the cradles, cutting away the enclosure shell and columns around the bottom of the gas holder except where the holder is supported by the cradles to a height slightly less than an extended jack, lifting the weight of the gas holder by the jacks in three-point effective support, cutting away the enclosure shell and columns above the cradles to a height slightly less than the extension length of the jacks, lowering the jacks and the shell and columns down around the piston structure until the weight of the gas holder is again supported by the cradles, and repeating the previous four steps in their same order until the gas holder has been lowered in height to where it can be dismantled in any other manner.

* * * * *